US011191368B2

(12) United States Patent
Manouchehri et al.

(10) Patent No.: US 11,191,368 B2
(45) Date of Patent: Dec. 7, 2021

(54) BABY CARRIER WRAP

(71) Applicant: LILLEBABY, LLC, Golden, CO (US)

(72) Inventors: Sandra Manouchehri, Montrose, CA (US); Lisbeth Lehan, Niwot, CO (US)

( * ) Notice: Subject to any disclaimer, the term of this patent is extended or adjusted under 35 U.S.C. 154(b) by 0 days.

(21) Appl. No.: 16/680,975

(22) Filed: Nov. 12, 2019

(65) Prior Publication Data

US 2020/0146464 A1 May 14, 2020

Related U.S. Application Data

(60) Provisional application No. 62/759,944, filed on Nov. 12, 2018.

(51) Int. Cl.
*A47D 13/02* (2006.01)

(52) U.S. Cl.
CPC ..... *A47D 13/025* (2013.01)

(58) Field of Classification Search
CPC ..... A47D 13/025
USPC ..... 224/159, 160; D3/214
See application file for complete search history.

(56) References Cited

U.S. PATENT DOCUMENTS 3,331,540 A * 7/1967 Higuchi ..... A47D 13/025 224/160
4,037,764 A * 7/1977 Almosnino ..... A47D 13/025 224/160
4,139,131 A * 2/1979 Hathaway ..... A47D 13/025 224/160
4,428,514 A * 1/1984 Elf ..... A47D 13/025 224/155
4,544,088 A * 10/1985 Reding ..... A47D 13/025 224/158
4,579,264 A * 4/1986 Napolitano ..... A47D 13/025 224/158
4,986,458 A * 1/1991 Linday ..... A47D 13/025 224/160
5,522,528 A * 6/1996 Petricola ..... A47D 13/025 224/160
6,045,018 A * 4/2000 Onishi ..... A47D 13/025 224/158
7,252,214 B2 * 8/2007 Krogh ..... A47D 13/025 224/158
7,669,743 B2 * 3/2010 Bruton ..... A47D 13/025 224/159
8,925,772 B2 * 1/2015 Vukovics ..... A47D 13/025 224/160
9,596,947 B2 * 3/2017 Lee ..... A47D 13/025
D882,244 S * 4/2020 Gibbons ..... D3/214
2011/0240693 A1 10/2011 Parness et al.
(Continued)

OTHER PUBLICATIONS

International Search Report and Written Opinion issued in related International Patent Application No. PCT/US2019/060854 dated Jan. 28, 2020.

*Primary Examiner* — Justin M Larson
(74) *Attorney, Agent, or Firm* — Winthrop & Weinstine, P.A.

(57) ABSTRACT

A baby carrier is disclosed. The baby carrier includes a plurality of wing elements including a first fabric. Each of the wing elements may include a terminal end. The baby carrier includes a back panel affixed to each of the wing elements. The back panel includes a second fabric and at least one opening configured to allow the terminal end of one of the wing elements to pass through the back panel to secure the back panel to the wing elements.

13 Claims, 14 Drawing Sheets

(56) References Cited

U.S. PATENT DOCUMENTS

| | | | | |
|---|---|---|---|---|
| 2013/0327796 | A1 | 12/2013 | Poiani | |
| 2014/0231473 | A1 | 8/2014 | Bailey et al. | |
| 2015/0028639 | A1 | 1/2015 | Brown | |
| 2017/0150826 | A1 | 6/2017 | Salazar et al. | |
| 2020/0146464 | A1* | 5/2020 | Manouchehri ..... | A47D 13/025 |

* cited by examiner

BABY CARRIER WRAP

CROSS REFERENCE TO RELATED APPLICATION

This application claims priority to U.S. Provisional Application No. 62/759,944, entitled "BABY CARRIER WRAP," filed on Nov. 12, 2018, the disclosure of which is incorporated by reference herein in its entirety.

TECHNICAL FIELD

The present disclosure relates to the field of wearable carriers, and particularly to a wearable carrier for carrying a baby, small child, or animal as well as methods of manufacturing and using the same.

BACKGROUND

Traditional soft carriers and/or wrap carriers include a single piece of fabric wrapped around the torso of an adult and a baby in such a manner that the baby is secured to the torso of the adult. Similar to swaddling, typical soft carriers and/or wrap carriers often require specialized knowledge to wrap the cloth around the adult and baby to ensure safety and comfort. Several known baby carriers have attempted to improve on the traditional soft carriers by including, for example, metal rings or other mechanisms to simplify the wrapping process. But these techniques often add unnecessary weight and bulk while providing minimal improvements in ease of use. A soft carrier and/or wrap carrier that is easy to use and lightweight could be beneficial.

SUMMARY

A baby carrier, such as a soft carrier, wrap carrier, and/or loop carrier, is disclosed. The baby carrier may include a back panel placed across the adult's back. The back panel is attached to wing elements that pass over the shoulders and across the torso of the adult and the baby. The back panel may include slits, channels, and/or other features which allow the wing elements to be secured to the back panel at multiple points. The wing elements are affixed to one another to secure the baby to the torso of the adult. The baby carrier may also include a base portion wrapped around the hips of the adult to provide additional support below the baby.

A baby carrier may include a plurality of wing elements including a first fabric, each of the wing elements including a terminal end. The baby carrier may include a back panel affixed to each of the wing elements, the back panel including a second fabric and at least one opening configured to allow the terminal end of one of the wing elements to pass through the back panel to secure the back panel to the wing elements.

According to one aspect, at least one opening comprises one or more channels each configured to accommodate a wing element passing through during use. According to one aspect, the channels span at least half of the back panel. According to one aspect, the channels include fabric panels sewn onto the back panel to form a passage to accommodate the wing elements. According to one aspect, the at least one opening includes a plurality of openings into a hollow interior of the back panel. According to one aspect, each of the wing elements is configured to pass through a first of the openings into the hollow interior of the back panel and out through a second of the openings. According to one aspect, at least one opening includes button holes through which the wing elements pass during use to secure the wing elements to the back panel. According to one aspect, the baby carrier includes a base portion configured to support the lower torso of a child. According to one aspect, the base portion includes at least one second opening configured to allow the terminal end of one of the wing elements to pass through to secure the base portion to the wing elements and back panel. According to one aspect, the first fabric is different from the second fabric. According to one aspect, the first fabric includes an elastic fabric and the second fabric includes one or more layers of minimally elastic material. According to one aspect, the second fabric includes at least one layer of knit fabric and at least one layer of non-woven interlining. According to one aspect, at least a portion of the first fabric and second fabric include water resistant material. According to one aspect, the back panel includes one or more of a triangular, rectangular, pentagonal, trapezoidal, and coffin shape to accommodate the posterior torso of an adult. According to one aspect, the wing elements are attached to the back panel at an angle relative to vertical. According to one aspect, the wing elements are configured to pass through the openings in the back panel and to be tied in a knot to secure a child to the torso of an adult.

A method of using a baby carrier may include providing a baby carrier including at least a plurality of wing elements including a first fabric and each of the wing elements including a terminal end. The baby carrier may also include a back panel affixed to each of the wing elements, the back panel including a second fabric and a plurality of openings each configured to allow the terminal end of one of the wing elements to pass through the back panel. The back panel is placed on the torso of a user, each of the wing elements may be passed over a shoulder of the user and around at least a portion of a child, each of the wing elements may be passed through one of the plurality of openings in back panel, and the wing elements are affixed to one another.

According to one aspect, a base portion is installed under the child. According to one aspect, the wing elements are affixed to one another using one or more of a knot, VELCRO, buckles, and loop fasteners.

A baby carrier may include a plurality of wing elements including a first fabric, each of the wing elements including a terminal end. The baby carrier may include a back panel affixed to each of the wing elements, the back panel including a second fabric and a plurality of openings each configured to allow the terminal end of one of the wing elements to pass through the back panel to secure the back panel to the wing elements. The baby carrier may include a base portion.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The foregoing and other features and advantages of the invention will be apparent from the following, more particular description of various exemplary embodiments, as illustrated in the accompanying drawings wherein like reference numbers generally indicate identical, functionally similar, and/or structurally similar elements. The first digits in the reference number indicate the drawing in which an element first appears.

DETAILED DESCRIPTION

Exemplary embodiments are discussed in detail below. While specific exemplary embodiments are discussed, it should be understood that this is done for illustration purposes only. In describing and illustrating the exemplary embodiments, specific terminology is employed for the sake of clarity. However, the embodiments are not intended to be limited to the specific terminology so selected. A person skilled in the relevant art will recognize that other components and configurations may be used without parting from the spirit and scope of the embodiments. It is to be understood that each specific element includes all technical equivalents that operate in a similar manner to accomplish a similar purpose. The examples and embodiments described herein are non-limiting examples.

All publications cited herein are hereby incorporated by reference in their entirety.

As used herein, the term "a" refers to one or more. The terms "including," "for example," "such as," "e.g.," "may be" and the like, are meant to include, but not be limited to, the listed examples.

As described and shown, a carrier is provided of the type that can be referred to as a soft carrier, wrap carrier, and/or loop wrap for carrying a baby, small child, or animal, for example. The carrier can include a back panel with wings of soft material attached to the back panel that cross over the front of the adult and can then be fed back through slits or channels in the back panel. The wings can be tied in the back or wrapped around the body again and then tied, for example, in the front. In another aspect of the carrier, a two-layered back panel includes channels crisscrossed between the layers, through which the wing material can be threaded. Various non-limiting implementations are described and shown.

Figure 1:
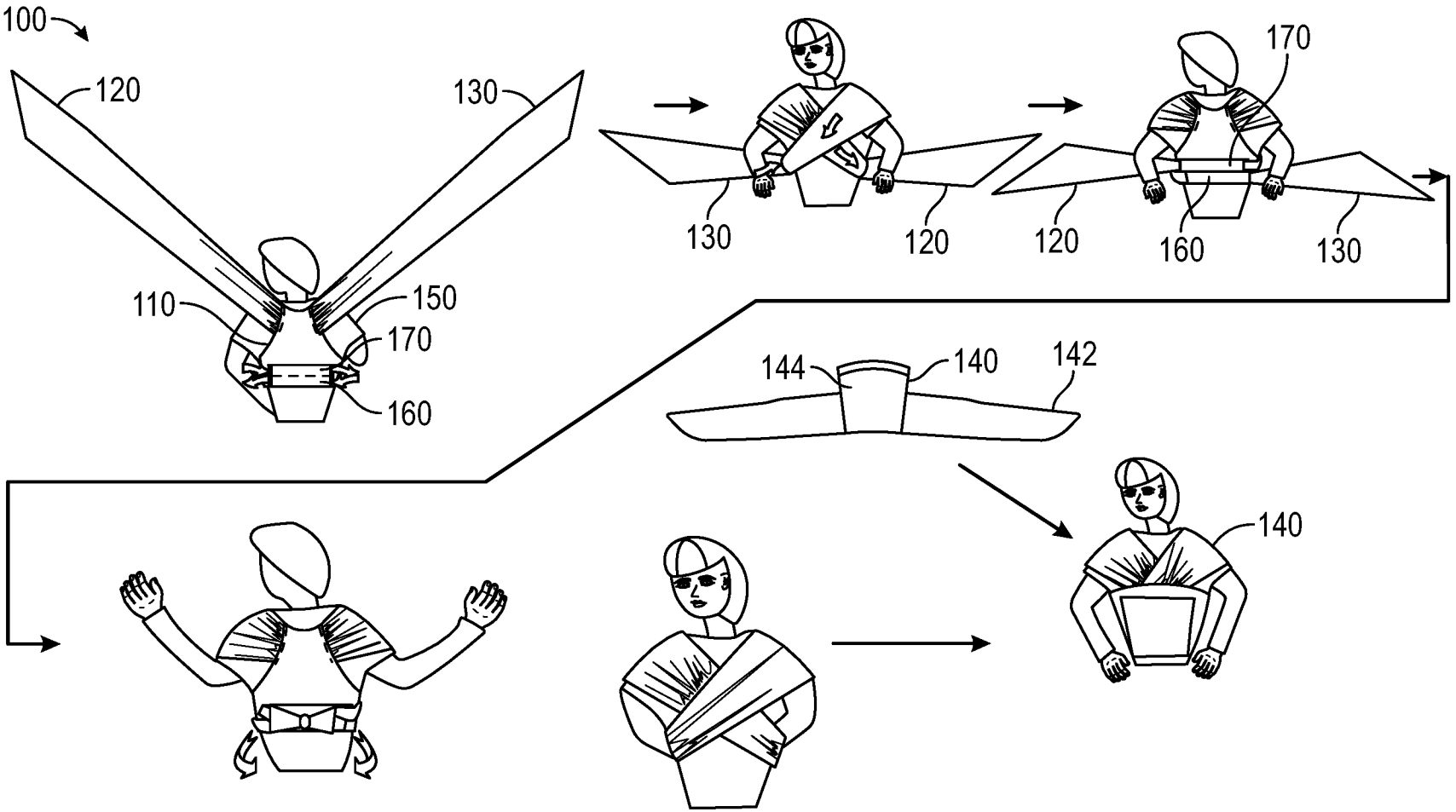
FIG. 1 is a diagram illustrating a baby carrier according to one of the various embodiments of the present disclosure.

FIG. 1 is a diagram illustrating a baby carrier according to one of the various embodiments of the present disclosure. A baby carrier 100 is disclosed. The baby carrier 100 may include a soft carrier, wrap carrier, and/or loop wrap. A loop wrap may include, for example, a wrap for carrying a baby that includes elements that cross-over and/or pass through themselves or other elements to affix the loop wrap to an adult and child.

In various embodiments, the baby carrier 100 may include a back panel 110, wing elements 120, 130, a base portion 140, and/or other components. The baby carrier 100 is used by an adult to carry a baby, small child, animal, and the like. The back panel 110 (e.g., back element, back portion, vest element, vest portion) may be made of one or more fabrics. In certain cases, the back panel 110 may include one of a variety of shapes, such as a pentagonal shape, trapezoid shape, triangular shape, oval shape, coffin shape, and the like. During use, the back panel 110 is in contact with a back or posterior portion of an adult user's 150 upper torso. In the example shown, wing elements 120, 130 are attached to the back panel 110. The attachment between the wing element 120, 130 and the back panel 110 may include a variety of stitching types as discussed herein. In certain cases, the back panel 110 includes one or more channels 160, 170. The channels 160, 170 may accommodate portions of the wing elements 120, 130. For example, the wing elements 120, 130 may pass through the channels 160, 170 when the baby carrier 110 is installed on an adult. Installed on the adult can refer to the assembly, wrapping and/or arrangement of the baby carrier 100 on an adult or adult user 150*by* the adult alone or in combination with assistance. The carrier 100 can be installed securely and reliably solely by the user on the user as a result of the innovative configuration and installation in accordance with the principles of the disclosure.

In various embodiments, the baby carrier 100 is attached to an adult user 150 according to set of steps or operations. A shown herein, a set of example steps are denoted with arrows depicting an order of steps. In a first step, the back panel 110 is placed on the posterior upper torso (back) of an adult 150. An upper portion of the back panel 110 is oriented relative to the shoulders of the adult 150, such that, for example, wing elements 120, 130 pass over the shoulders of the adult 150.

In a second step, the wing elements 120, 130 are passed over the shoulders of the adult 150. In one example, a left wing element 120 is be passed over the left shoulder of the adult 150 and a right wing element 130 is passed over the right shoulder of the adult 150. The wing elements 120, 130 are crossed in front of the anterior upper torso (chest) of the adult 150. The wing elements 120, 130 may be crossed leaving enough slack to accommodate a baby (not shown). For example, the wing elements 120, 130 may be crossed around the torso and/or body of a baby (or animal), such that the baby is held in contact with the upper torso of the adult 150. The baby (e.g., child user) may be oriented in a variety of configurations, such as facing forward, facing the adult, laying down, and the like.

In a third step, the wing elements 120, 130 are passed through channels 160, 170 in the back panel 110. The channels 160, 170 may include a piece of overlay fabric (e.g., a fabric panel) affixed to the back panel 110 that creates tunnel(s) (passageways) for the wing elements 120, 130 to pass through. In the example shown, a left wing element 120 is passed through an upper channel 170 of the back panel 110, and a right wing element 130 is passed through a lower channel 160 of the back panel 110. In another example, both wing elements 120, 130 may be passed through a single channel, such as the upper channel 170 or the lower channel 160. Passing both wing elements 120, 130 through a single channel may allow the baby carrier 100 to be adjusted for different sized adults 150. For example, a taller or larger adult 150 may pass both wing elements through the bottom channel element 160 to effectively increase the overall height of the baby carrier 110. The upper channel element 170 may be used for smaller or shorter adults 150. The wing elements 120, 130 may be adjusted after passing through the channel elements 160, 170 to achieve the proper tension around the baby. The wing elements 120, 130 may be adjusted to achieve a secure hold on the baby while maintaining comfort for the adult 150.

In a fourth step, the wing elements 120, 130 are affixed to one another. In certain cases, the wing elements 120, 130 are tied together posterior to the adult (as shown), in the anterior of the adult (not shown), or in another location. The wing elements 120, 130 may be tied using any suitable knot. The wing elements 120, 130 may also be attached to one another using VELCRO, buckles, hook and loop fasteners, snaps, hooks, and/or any other mechanism of temporary and/or removable attachment.

In a fifth step, a base portion 140 is installed. The base portion 140 includes one or more belt elements 142 and body element 144. The belt elements 142 wrap around the waist of the adult and are affixed to one another using a variety of mechanisms, such as VELCRO, buckles, snaps, a knot, and or any other suitable fastening mechanism. The base portion 140 is configured to further support the baby and ensure the baby is held securely in place during use. In certain cases, the base portion 140 is not attached to the back panel 110 and wing elements 120, 130. In some cases, the base portion is affixed to the back panel 110, wing element 120, 130, and/or other components of the baby carrier 100.

In various embodiments, the baby carrier 100 is installed on an adult user 150 with a child user and used for a period of time. Later in time, one or more of the steps may be undone to remove the child user from the baby carrier 100. In certain cases, the baby carrier 100 is loosened so that it can be removed, but not fully disassembled. By loosening without fully disassembling the baby carrier 100, the carrier 100 can be easily installed for subsequent use.

Figure 2:
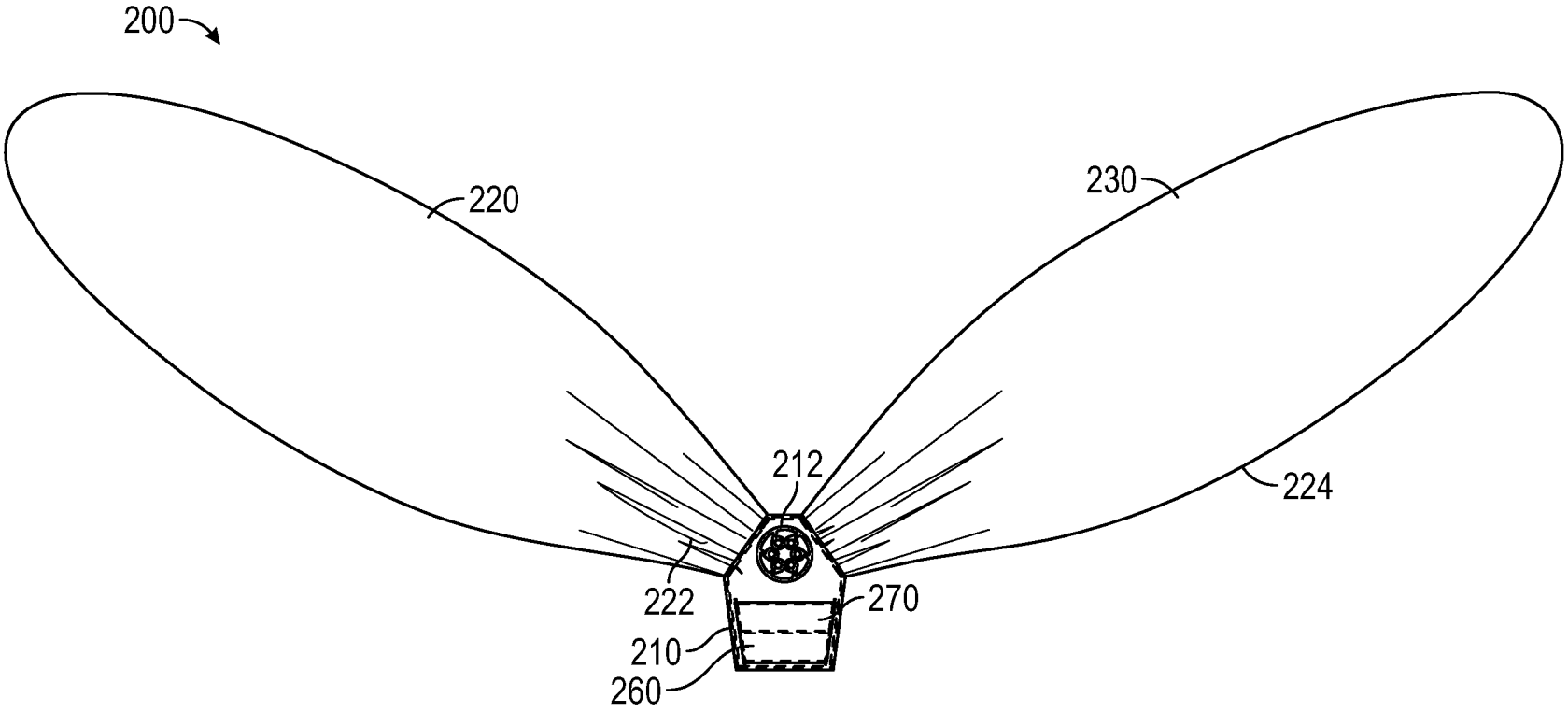
FIG. 2 is a diagram illustrating a baby carrier according to one of the various embodiments of the present disclosure.

FIG. 2 is a diagram illustrating a baby carrier according to one of the various embodiments of the present disclosure. In the example shown, a baby carrier 200 includes a back panel 210, wing elements 220, 230, and/or other features. The baby carrier 200 may be similar to baby carrier 100 of FIG. 1. The back panel 210 and wing elements 220, 230 may include the same type of fabric and/or different types of fabrics. The wing elements 220, 230 may include an elastic fabric (e.g., a stretch fabric) and the back panel 210 may include a non-less elastic material, such as canvas, knit fabric, non-woven fabric, and/or another material. The wing elements 220, 230 may be affixed to the back panel 210 using various sewing techniques. In the example shown, the wing elements 220, 230 are oval shaped to provide ample fabric for wrapping around the adult and baby. Oval shape wing element 220, 230, relative to, e.g., rectangular shaped wing elements, provide more material to wrap around the baby. Additional material provides more options in configuring the baby carrier 200 for safety and comfort of the adult and baby. In certain cases, the wing elements 220, 230 may include shirring 222 to provide stretch (elasticity) relative to the back panel 210. The elasticity may provide a snug fit between the adult and child using the baby carrier 200. In some instances, the edges 224 of the wing elements 220, 230 may include stitched or overlock edges, such as those referred to as Merrow edges, raw edges, and/or other types of edges. Merrow edges may, for example, improve the durability of the baby carrier. In certain cases, the wing elements 220, 230 include self-binding stitching all around. For example, ¼ inch self-binding stitching may be used along the edges of the wing elements 220, 230.

In certain cases, the back panel 210 includes channels 260, 270 to accommodate the wing elements 220, 230 during use of the baby carrier 200. The channels 260, 270 may include an overlay panel forming a tunnel underneath. The back panel 210 may also include stitching 212 (e.g., center back panel stitching). The stitching 212 may increase the structural integrity of the back panel 210. The stitching 212 may also be used for aesthetic purposes.

Figure 3:
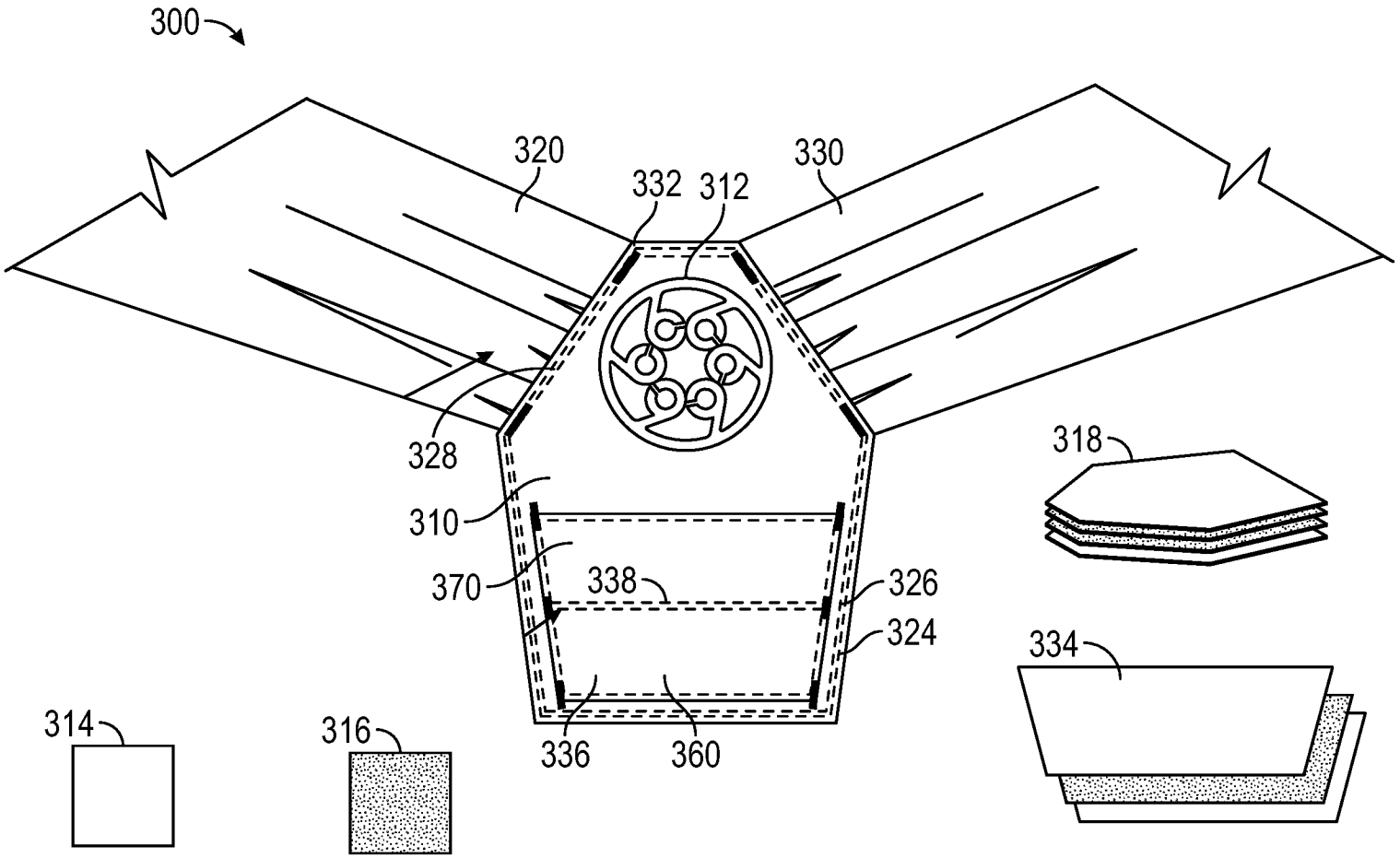
FIG. 3 is a diagram illustrating a portion of a baby carrier according to one of the various embodiments of the present disclosure.

FIG. 3 is a diagram illustrating a portion of a baby carrier according to one of the various embodiments of the present disclosure. In the example shown, a baby carrier 300 includes a back panel 310, wing elements 320, 330, and/or other features. The baby carrier 300 and components thereof may be similar to baby carriers 100 of FIG. 1 and 200 of FIG. 2. As shown, the back panel 310 may include multiple layer construction 318. In one example, the back panel 310 may include a four layer construction 318, including two layers of knit fabric 314, layers of heavy non-woven interlining 316, and/or other layers. The four layers may include a sandwich. A first layer may include knit fabric 314, such as Modal 220 GMS and/or another type of fabric. The second and/or third layers 316 may include heavy non-woven interlining, canvas, and/or any other material. Canvas materials may include, for example, nine or ten ounce poly canvas and/or any other type of canvas. And a fourth layer may include knit fabric 314.

In some embodiments, layers of material in the back panel 310, wing elements 320, 330, and/or other components of the baby carrier 300 may include waterproof or water-resistant materials. For example, an outer layer of the back panel 310 and/or wing elements 320, 330 may include water proof materials. In certain cases, material used in the back panel 310, wing elements 320, 330, and/or other components of the baby carrier 300 may be include perforated fabric to increase breathability of the carrier 300.

In certain cases, the layers of the back panel may be stitched along the perimeter seam 324 of the back panel 310. For example, the seam 324 may include double needle stitching, such as ¼ inch double needle stitching. Seams 324 of the back panel 310 may also include seam tape 326 to increase the structural strength and durability. The seams 324 may also include turned construction. In locations of the seams 324 susceptible to higher loading, stress, or increased wear, bar tack stitching 332 is used to strengthen the seam. Bar tack stitching 332 provides additional structural strength to offset stress points in the baby carrier 310.

In some embodiments, a seam 328 between the back panel 310 and wing elements 320, 330 may include stitching, seam tape 326, bar tack stitching 332, and/or other features. In one example, a seam 328 between the back panel 310 and wing element 320, 330 includes the wing element inset to the seam with a seam allowance of, for example, one inch.

In certain cases, the back panel 310 includes one or more channel elements 360, 370. The channel elements 360, 370 (e.g., channels) may include fabric sewn onto the back panel to create a passage through which the wing elements pass during use. The channel elements 360, 370 may include a layered construction 334, including layers of knit fabric 314, layers of heavy non-woven interlining 316, and/or other layers. In one example, a layered construction 334 may include three layers. A first layer may include knit fabric 314, such as Modal 220 GMS and/or another type of fabric. The second layers may include heavy non-woven interlining 316. And a third layer may include knit fabric 314. In certain cases, multiple channels 360, 370 may be formed by a single panel piece 336. The single panel piece 336 may be affixed to the back panel 310. Two channel elements 360, 370 may be formed by a seam 338, such as a double needle stitch seam, through a single panel piece 336 to form the two channel elements 360, 370. In certain cases, corners or other locations likely to be subjected to high stress or wear may be reinforced by bar tack stitching 332.

In various embodiments, the back panel 310 may include one channel, three channels, and/or any other number of channels. Additional channels may be formed using the techniques disclosed herein. For example, a single panel piece 336 may be divided into any other number of channels by forming seams 338 to divide the channels.

In certain cases, the back panel 310 includes emblem stitching 312 (e.g., center back panel stitching). The emblem stitching 312 may include stitching through a multiple layer construction 318. The stitching 312 may increase the structural integrity of the back panel 210. The stitching 212 may also be used for aesthetic purposes.

In various embodiments (not shown), the channel elements 360, 370 may be located on the side of the back panel 310 that is in contact with the back of the adult 150. In that case, the channel elements are on the opposite side of the back panel 310 form the version shown in FIG. 3. The channel elements 360, 370 in such a configuration may be hidden from view during use of the baby carrier 300. The installation and use of the baby carrier 300 in such a configuration may be similar to the steps described herein, for example, in FIG. 1.

Figure 4:
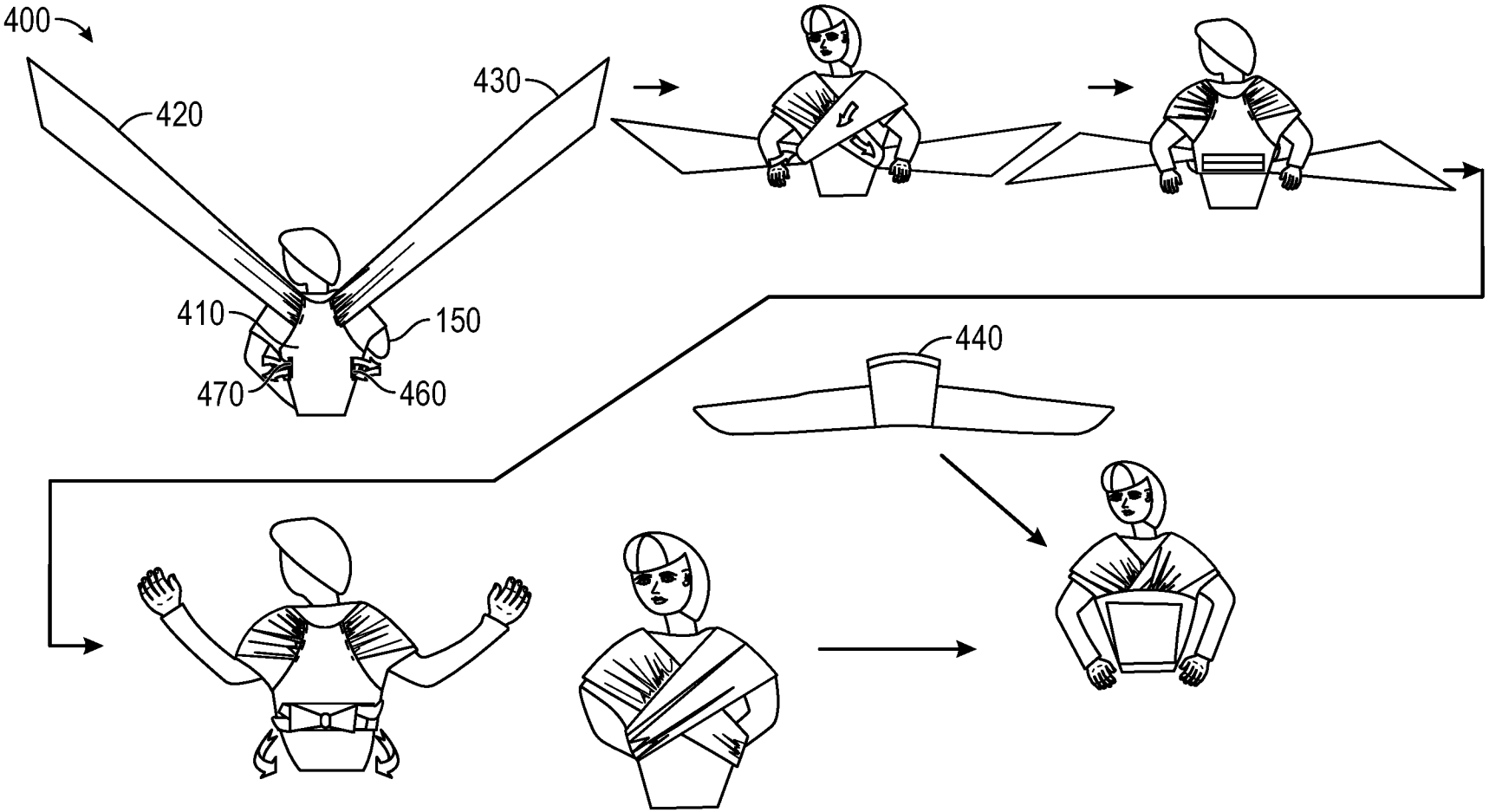
FIG. 4 is a diagram illustrating a baby carrier according to one of the various embodiments of the present disclosure.

FIG. 4 is a diagram illustrating a baby carrier according to one of the various embodiments of the present disclosure. A baby carrier 400 may include a back panel 410, wing elements 420, 430, a base portion 440, and/or other components. The baby carrier 400 may be similar to baby carriers 100, 200, 300 of FIGS. 1-3, with certain variations.

In various embodiments, the back panel 410 is affixed to multiple wing elements 420, 430. The attachment between the wing elements 420, 430 and the back panel 410 may include stitching of various types as discussed herein. The back panel 410 may include one or slits 460, 470 (e.g., cuts, button holes, apertures, clefts, etc.). The slits 460, 470 include openings cuts in the back panel 410. The slits 460, 470 may, for example, resemble button holes. Slits 460, 470 may include reinforced stitching, such as bar tack, zig-zag, or other stitching. The slits 460, 470 are sized to accommodate the wing elements 420, 430 passing through. A back panel 410 may include a right slit 460, a left slit 470, and/or other slits. The slits 460, 470 accommodate portions of the wing elements 420, 430. For example, the wing elements 420, 430 may pass through the slits 460, 470 when the baby carrier 400 is installed on an adult. In certain cases, the right wing element 430 may be passed through the left slit 470 and the left wing element 420 may be passed through the right slit 460.

In various embodiments, the baby carrier 400 is attached to an adult 150 according to set of steps. In a first step, the back panel 410 is placed on the posterior upper torso of an adult 150. An upper portion of the back panel 410 is oriented relative to the shoulders of the adult 150, such that, for example, wing elements 420, 430 pass over the shoulders of the adult 150.

In a second step, the wing elements 420, 430 are passed over the shoulders of the adult 150. In one example, a left wing element 420 is passed over the left shoulder of the adult 150 and a right wing element 430 is passed over the right shoulder of the adult. The wing elements 420, 430 are crossed in front of the posterior upper torso (chest) of the adult 150. The left wing element 420 may be passed downward across the body from the left shoulder to the right hip, and the right wing element 430 may be passed downward across the body from the right shoulder to the left hip. The result being a cross across the upper torso of the adult 150 and baby (not shown). The wing elements 420, 430 may be crossed leaving enough slack to accommodate and support a baby.

In a third step, the wing elements 420, 430 are passed through slits 460, 470 in the back panel 410. Continuing from step two, the left wing element 420 is passed across the posterior portion of the torso (the chest) toward the right slit 460, and the right wing element 430 is passed across the posterior portion of the torso toward the left slit 470. In certain cases, the right wing element 430 passes through the left slit 470 from the anterior (front) to posterior (back). The right wing element 430 is then drawn across the lower posterior torso (lower back) and passed through the right slit 470. Similarly the left wing element 420 passes through the right slit 460 from the anterior (front) to posterior (back). The left wing element 420 is drawn across the lower posterior torso (lower back) and passed through the left slit 470.

In a fourth step, the wing elements 420, 430 are affixed to one another. In certain cases, the wing elements 420, 430 are tied together in the posterior of the adult (as shown), in the anterior of the adult (not shown), or in another location. The wing elements 420, 430 may be tied using any suitable knot. The wing elements 420, 430 may also be attached to one another using VELCRO, buckles, hook and loop fasteners, snaps, hooks, and/or any other mechanism of temporary and/or removable attachment.

In a fifth step, a base portion 440 is installed. The base portion 440 wraps around the waist of the adult and is affixed to one another using a variety of mechanisms, such as VELCRO, buckles, snaps, a knot, and or any other suitable fastening mechanism. The base portion 440 is configured to further support the baby and ensure the baby is held securely in place during use.

Figure 5:
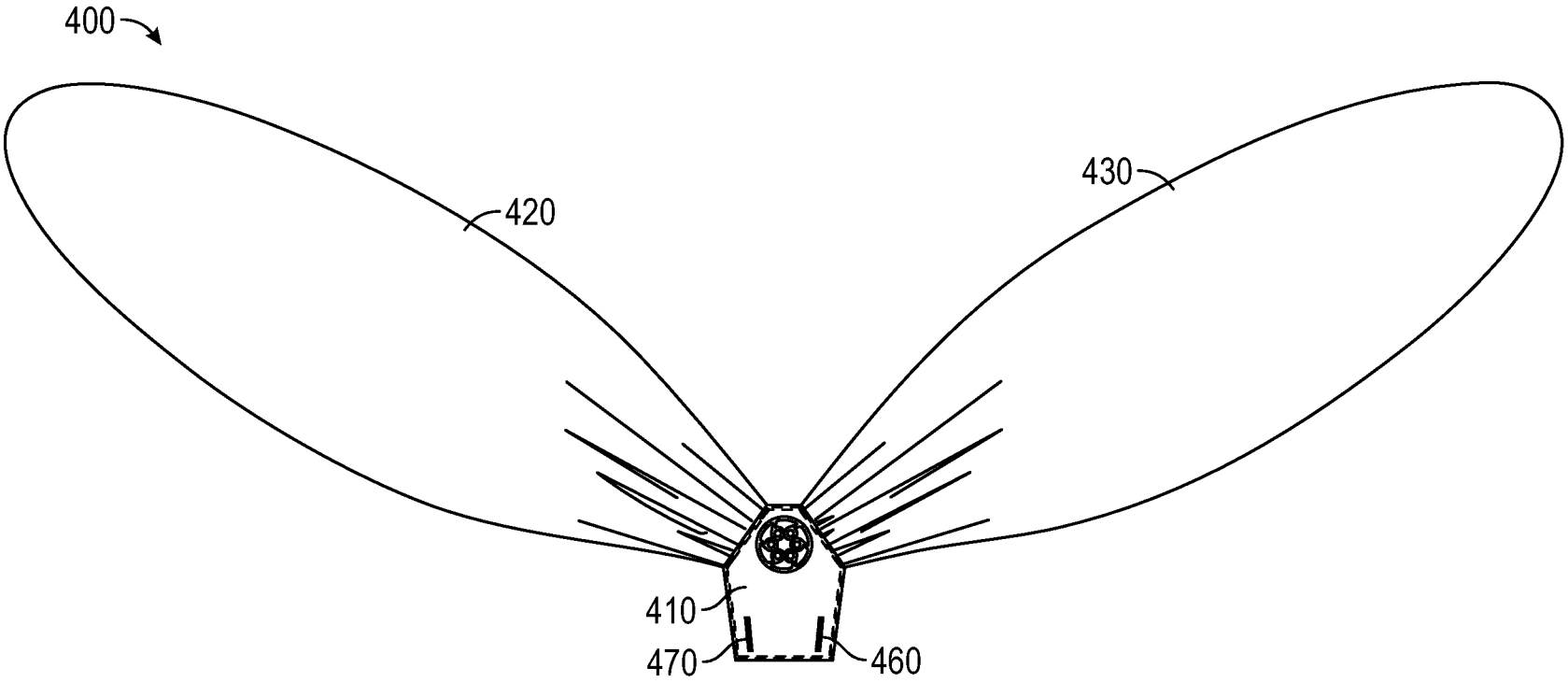
FIG. 5 is a diagram illustrating a baby carrier according to one of the various embodiments of the present disclosure.

FIG. 5 is a diagram illustrating a baby carrier according to one of the various embodiments of the present disclosure. In the example shown, a baby carrier 400 includes a back panel 410, wing elements 420, 430, and/or other features. The wing elements 420, 430 are affixed to upper portions of the back panel 410 using various sewing techniques. The wing elements 420, 430 may include an oval shape and/or other shape suitable for wrapping around a small child. In certain cases, the back panel 410 includes slits 460, 470 to accommodate the wing elements 420, 430 during use of the baby carrier 400 as discussed herein.

Figure 6:
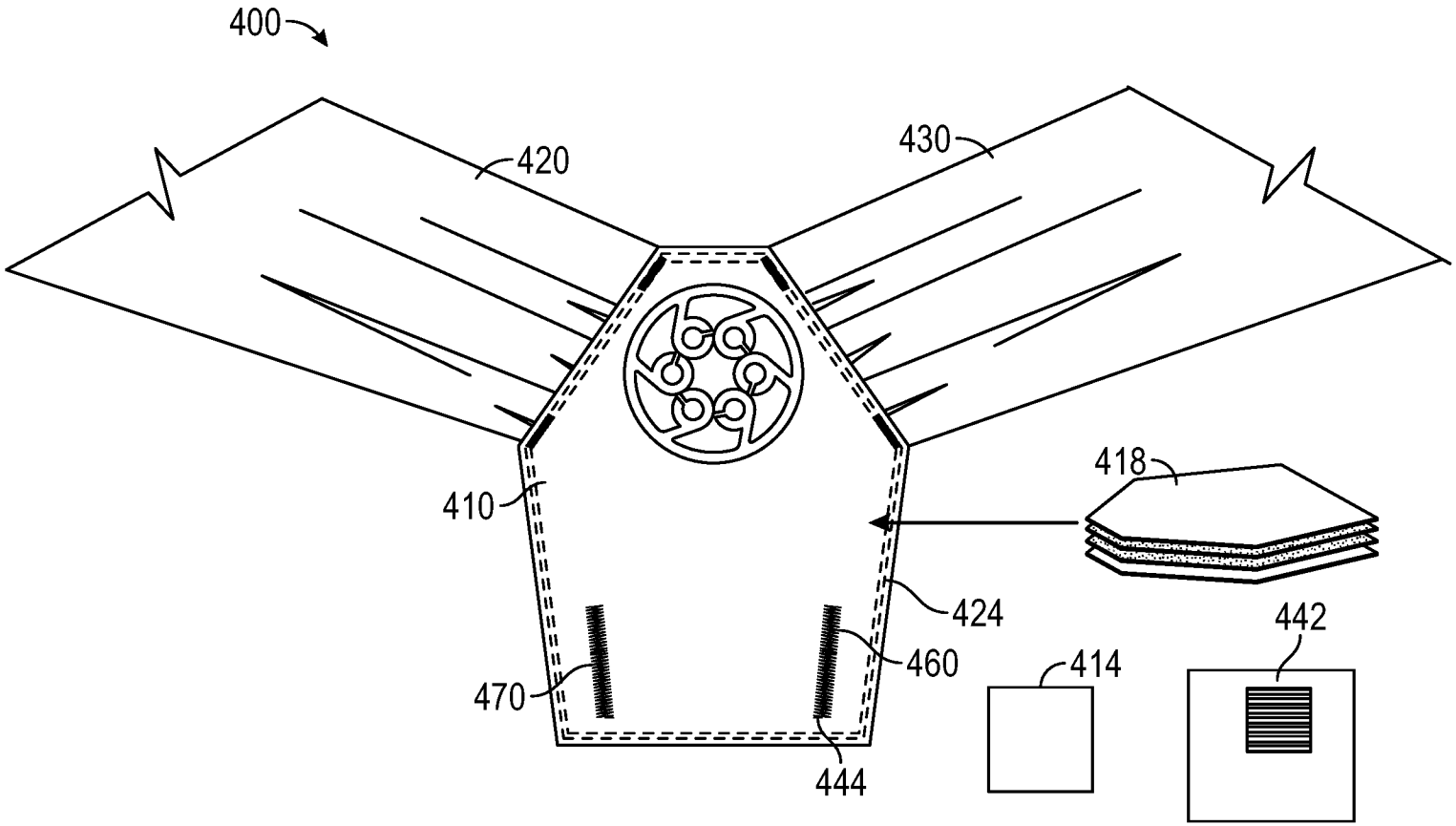
FIG. 6 is a diagram illustrating a portion of a baby carrier according to one of the various embodiments of the present disclosure.

FIG. 6 is a diagram illustrating a portion of a baby carrier according to one of the various embodiments of the present disclosure. In the example show, a baby carrier 400 includes a back panel 410, wing elements 420, 430, and/or other features. As shown, the back panel 410 may include a multiple layer construction 418. In one example, the back panel 410 may include a four layer construction 418, including two layers of knit fabric 414, layers of canvas 442, and/or other layers. The four layers may include a sandwich. A first layer may include knit fabric 414. The second and/or third layers may include canvas 442 and/or another material. And a fourth layer may include knit fabric 414. In certain cases, the back panel 410 may include different fabric in different locations. For example, a portion of the back panel 410 may include multiple layer construction with knit fabric 414 layers and heavy non-woven fabric layers 316. Another portion of the back panel 410 may include a multiple layer construction with knit fabric 414 layers and canvas 442 layers. For example, the multiple layer construction with canvas 442 may be used around the slits 460, 470 and other portions of the back panel 410 include a multiple layer construction with heavy non-woven fabric 316. The layers of the back panel may be stitched along the perimeter seam 424 of the back panel 410. For example, the seam 424 may include double needle stitching, such as ¼ inch double needle stitching.

In certain cases, the back panel 410 includes one or more slits 460, 470. The slits 460, 470 may include cuts through the back panel 410. In one example, the slits 460, 470 include a ⅛ inch opening with zig-zag stitching 444. Zig-zag stitching 444 and/or bar tack stitching 332 reinforces the slit 460, 470 to prevent wear to baby carrier 400 over extended use.

Figure 7:
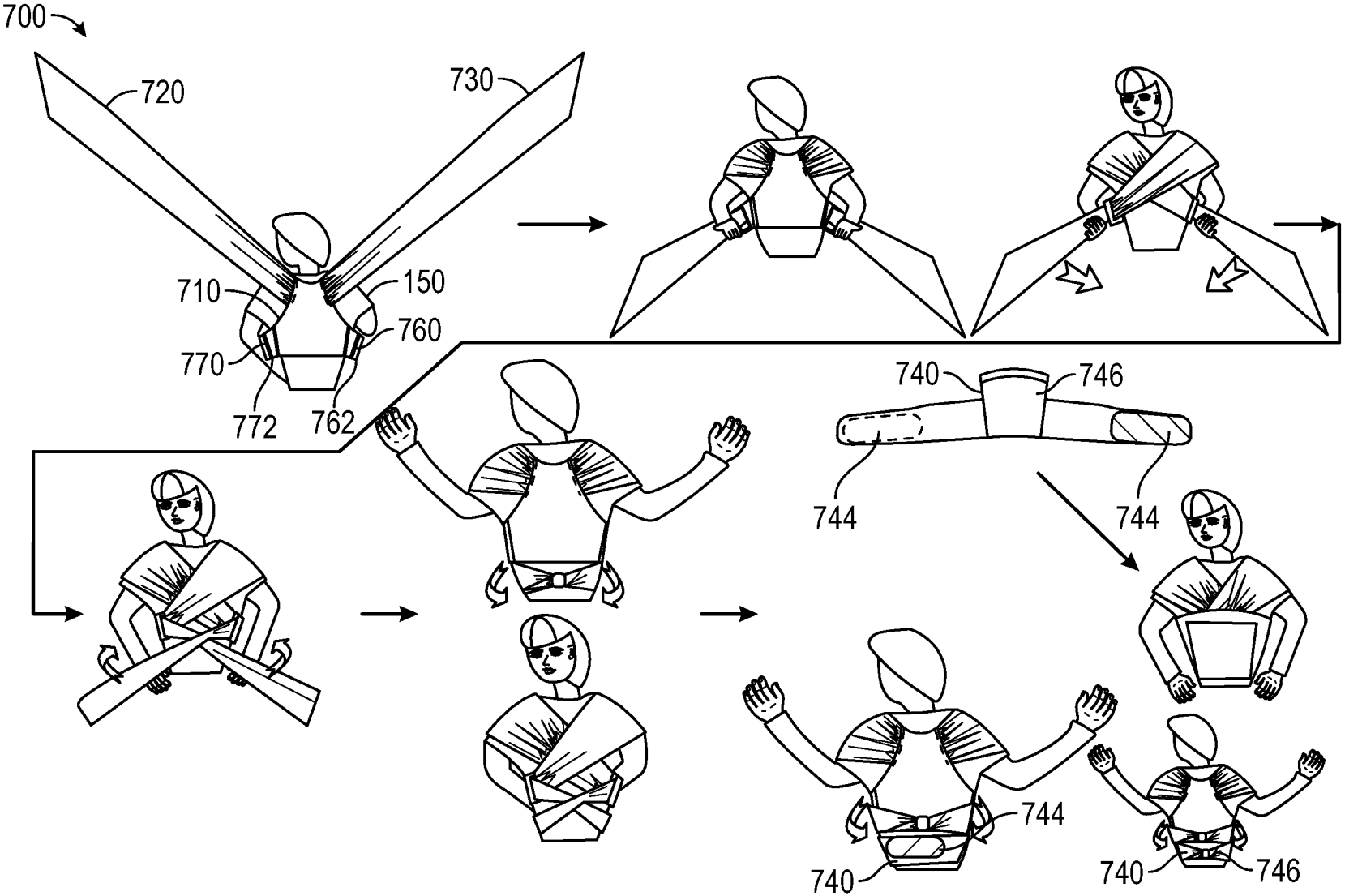
FIG. 7 is a diagram illustrating a baby carrier according to one of the various embodiments of the present disclosure.

FIG. 7 is a diagram illustrating a baby carrier according to one of the various embodiments of the present disclosure. A baby carrier 700 may include a back panel 710, wing elements 720, 730, a base portion 740, and/or other components. The baby carrier 700 may be similar to baby carrier 100, 200, 300 of FIGS. 1-3 and baby carrier 400 of FIGS. 4-6, with certain variations.

In various embodiments, the back panel 710 is affixed to multiple wing elements 720, 730. The attachment between the wing elements 720, 730 and the back panel 710 may include stitching of various types as discussed herein. The back panel 710 includes one or more flaps 762, 772 (e.g., fabric tabs). The flaps 762, 772, for example, a right flap 762 and left flap 772, may be sewn to the back panel 710 using the various sewing techniques discussed herein or known in the art. In certain cases, each of the flaps includes a slit 760, 770. The slits 760, 770 may, for example, resemble button holes. Slits 760, 770 may include reinforced stitching, such as zig-zag stitching, bar tack stitching, and the like. A right slit 760 may be include in the right flap 762 and a left slit 770 may be included in the left flap 772. The slits 760, 770 accommodate portions of the wing elements 720, 730. For example, the wing elements 720, 730 may pass through the slits 760, 770 when the baby carrier 700 is installed on an adult.

In various embodiments, the baby carrier 700 is attached to an adult 150 according to a set of steps. In a first step, the back panel 710 is placed on the posterior upper torso of an adult 150. An upper portion of the back panel 710 is oriented relative to the shoulders of the adult 150, such that, for example, wing elements 720, 730 pass over the shoulders of the adult 150.

In a second step, the wing elements 720, 730 are passed over the shoulders of the adult 150. The wing elements 720, 730 are crossed in front of the posterior upper torso (chest) of the adult 150. The left wing element 720 may be passed downward across the body from the left shoulder to the right hip, and the right wing element 730 may be passed downward across the body from the right shoulder to the left hip. The wing elements 720, 730 are passed through slits 760, 770. The left wing element 720 passes through the right slit 760 from the anterior (front) to posterior (back). The right wing element 730 passes through the left slit 770 from the anterior (front) to posterior (back).

In a third step, the wing elements 720, 730 are crossed in front of the torso of the adult 150 and/or child (not shown). After passing through the slits 760, 770, the wing elements 720, 730 are pulled forward and crossed in front of the adult 150. The wing elements 760, 770 may then be wrapped around the waist of the adult 150. The result of this step may include two crosses of fabric in front of the torso of the adult 150 and/or child (not shown).

In a fourth step, the wing elements 720, 730 are affixed to one another posterior to the adult (behind the adult). In certain cases, the wing elements 720, 730 are tied together in the anterior of the adult (as shown), in the posterior of the adult (not shown), or in another location. The wing elements 720, 730 may be tied using any suitable knot. The wing elements 720, 730 may also be attached to one another using VELCRO, buckles, snaps, hooks, and/or any other mechanism of temporary attachment.

In a fifth step, a base portion 740 is installed. The base portion 740 wraps around the waist of the adult and is affixed to one another using a variety of mechanisms, such as VELCRO 744, buckles, snaps, a knot, and or any other suitable fastening mechanism. In a first configuration 5*a*, the base portion 740 includes a VELCRO 744 attachment around the waist of the adult 150. In a second configuration, the base portion includes a knot securing the base portion around the waist of the adult 150. The base portion 740 is configured to further support the baby and ensure the baby is held securely in place during use.

In some embodiments, the base portion may include a pocket 746. The pocket 746 may be used, by an adult for example, to store personal belongs. In certain cases, the pocket 746 and/or another portion of the base portion 740 may include a flap of weather resistant material that may be used to cover the child from rain, snow, and/or adverse weather conditions. The flap may for example attach to other portions of the carrier 700, such as the wing elements 720, 730 to create a cover for the child. The flap may cover the child in such a manner so as to not inhibit proper ventilation to the child.

Figure 8:
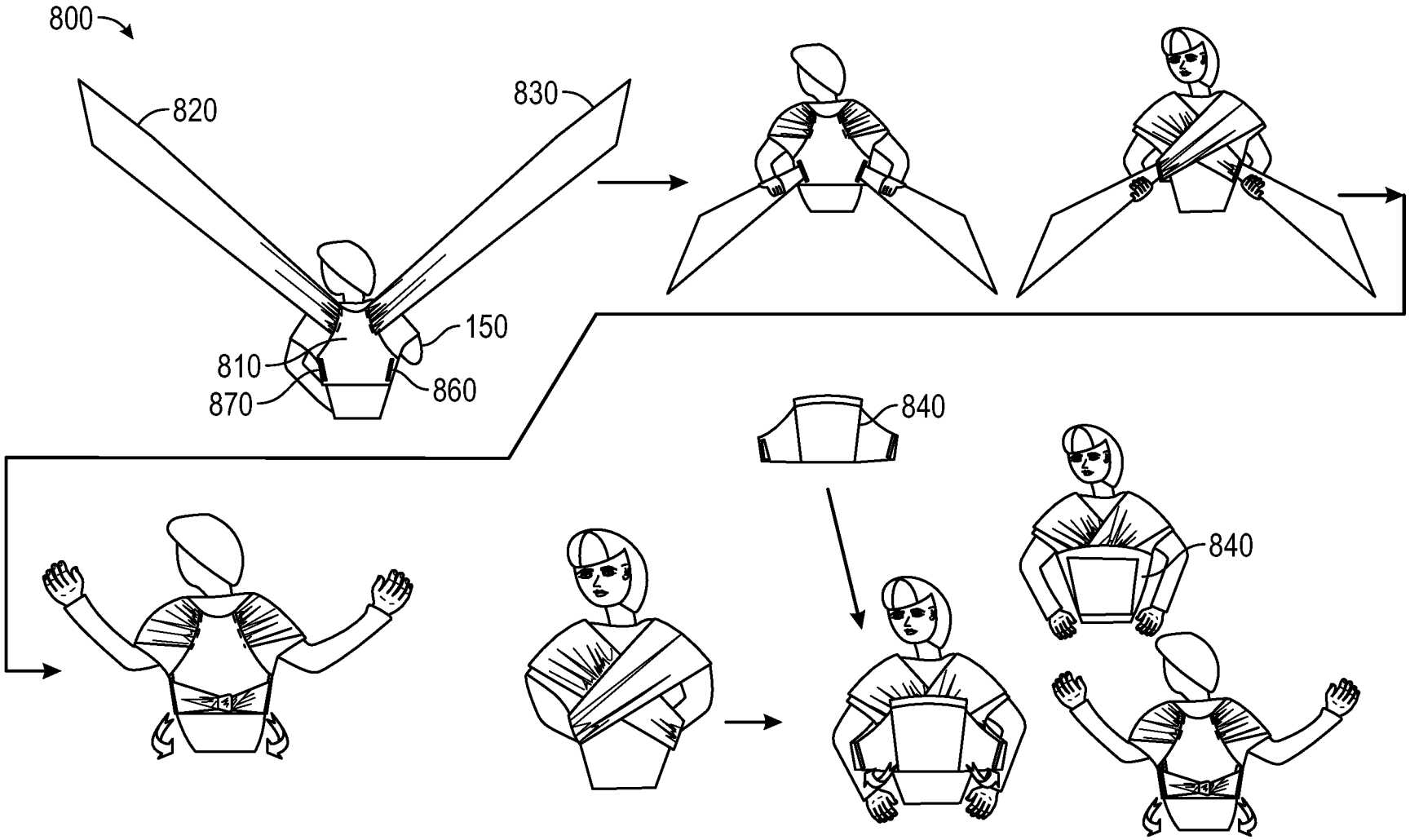
FIG. 8 is a diagram illustrating a baby carrier according to one of the various embodiments of the present disclosure.

FIG. 8 is a diagram illustrating a baby carrier according to one of the various embodiments of the present disclosure. A baby carrier 800 may include a back panel 810, wing elements 820, 830, a base portion 840, and/or other components. The baby carrier 800 may be similar to baby carrier 100, 200, 300 of FIGS. 1-3, baby carrier 400 of FIGS. 4-6, and/or baby carrier 700 of FIG. 7, with certain variations.

In various embodiments, the back panel 810 is affixed to multiple wing elements 820, 830. The back panel 810 includes slits 860, 870. The slits 860, 870 may be cut into the back panel 810. Slits 860, 870 may include reinforced stitching, such as zig-zag stitching, bar tack stitching, and the like.

In various embodiments, the baby carrier 800 is attached to an adult 150 according to set of steps. In a first step, the back panel 810 is placed on the posterior upper torso of an adult 150. An upper portion of the back panel 810 is oriented relative to the shoulders of the adult 150, such that, for example, wing elements 820, 830 pass over the shoulders of the adult 150.

In a second step, the wing elements 820, 830 are passed over the shoulders of the adult 150. The wing elements 820, 830 are crossed in front of the posterior upper torso (chest) of the adult 150. The left wing element 820 may be passed downward across the body from the left shoulder to the right hip, and the right wing element 830 may be passed downward across the body from the right shoulder to the left hip. The wing elements 820, 830 are passed through slits 860, 870. The left wing element 820 passes through the right slit 860 from the anterior (front) to posterior (back). The right wing element 830 passes through the left slit 870 from the anterior (front) to posterior (back).

In a third step, the wing elements 820, 830 are affixed to one another posterior to the adult (behind the adult). In certain cases, the wing elements 820, 830 are tied together in the anterior of the adult (as shown), in the posterior of the adult (not shown), or in another location. The wing elements 820, 830 may be tied using a knot, VELCRO, buckles, snaps, hooks, and/or any other mechanism of temporary attachment.

In a fourth step, a base portion 840 is installed. The base portion 840 wraps around the waist of the adult and is affixed to one another using a variety of mechanisms, such as VELCRO, buckles, snaps, a knot, and or any other suitable fastening mechanism.

Figure 9:
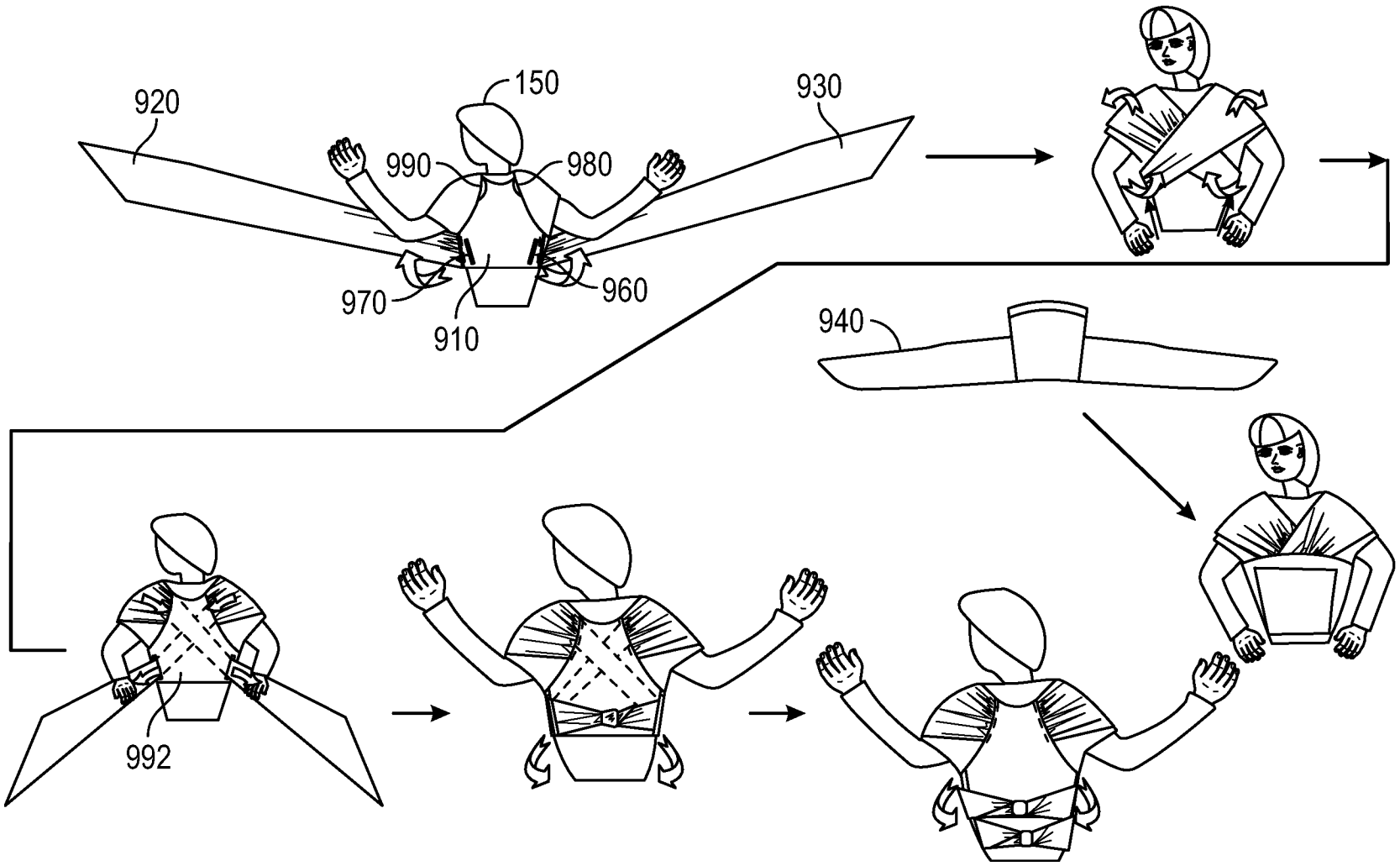
FIG. 9 is a diagram illustrating a baby carrier according to one of the various embodiments of the present disclosure.

FIG. 9 is a diagram illustrating a baby carrier according to one of the various embodiments of the present disclosure. A baby carrier 900 may include a back panel 910, wing elements 920, 930, a base portion 940, and/or other components. The baby carrier 900 may be similar to baby carrier 100, 200, 300 of FIGS. 1-3, baby carrier 400 of FIGS. 4-6, baby carrier 700 of FIG. 7, and/or baby carrier 800 of FIG. 8, with certain variations.

In various embodiments, the back panel 810 is affixed to one or more wing elements 920, 930. The wing elements 920, 930 are affixed (e.g., stitched) to a lower portion of the back panel 910. For example, a left wing element 920 may be affixed to a lower left portion of the back panel 910, and a right wing element 930 may be affixed to the lower right portion of the back panel 910. The wing elements 920, 930 may be affixed to the back panel 910 using any of the techniques discussed herein or known in the art.

In various embodiments, the back panel 910 includes lower slits (openings) 960, 970, upper slits 980, 990, hollow inner portion 992, and/or other features. The back panel 910 may include multiple layers of fabric with a hollow portion 992 (e.g., opening, tunnel) between the outer layer and inner layer of fabric. The back panel 910 may be hollow allowing the wing elements 920, 930 to pass through the back panel 910. The lower slits 960, 970 may not be through all layers of the back panel 910. The lower slits 960, 970 may, for example, be cutouts through only the outer layer(s) of the back panel 910. The slits 960, 970 may provide access to the hollow inner portion 992 of the back panel 910. The upper slits 980, 990 also provide access to the hollow inner portion 992 of the back panel 910.

In various embodiments, the baby carrier 900 is attached to an adult 150 according to set of steps. In a first step, the back panel 910 is placed on the posterior upper torso of an adult 150. An upper portion of the back panel 910 is oriented relative to the shoulders of the adult 150, and the lower portion of the back panel 910 is oriented relative to the waist of the adult 150.

In a second step, the wing elements 920, 930 are drawn across the anterior torso of the adult and/or across the child. The left wing element 920 may be passed upward across the body from the left hip to the right shoulder, and the right wing element 930 may be passed upward across the body from the right hip to the left shoulder. The wing elements 920, 930 are passed over the shoulders of the adult 150.

In a third step, the wing elements 920, 930 are passed through the upper slits 980, 990 of the back panel, through the hollow portion 992, and out the lower slits 960, 970. Continuing from the previous step, the left wing element 920 is passed over the right shoulder of the adult 150 and into a right upper slit 980 of the back panel 910. The left wing element 920 is then passed through the hollow portion 992 of the back panel 910, across the posterior torso of the adult from the right shoulder to the left hip, and out the lower left slit 970. The right wing element 930 is passed over the left shoulder of the adult 150 and into a left upper slit 990 of the back panel 910. The right wing element 930 is then passed through the hollow portion 992 of the back panel 910, across the posterior torso of the adult from the left shoulder to the right hip, and out the lower right slit 960.

In a fourth step, the wing elements 920, 930 are affixed to one another. In certain cases, the wing elements 920, 930 are tied together in the anterior of the adult (as shown), in the posterior of the adult (not shown), or in another location. The wing elements 920, 930 may be tied using a knot, VELCRO, buckles, snaps, hooks, and/or any other mechanism of temporary attachment.

In a fifth step, a base portion 940 is installed. The base portion 940 wraps around the waist of the adult and is affixed to one another using a variety of mechanisms, such as VELCRO, buckles, snaps, a knot, and or any other suitable fastening mechanism.

Figure 10:
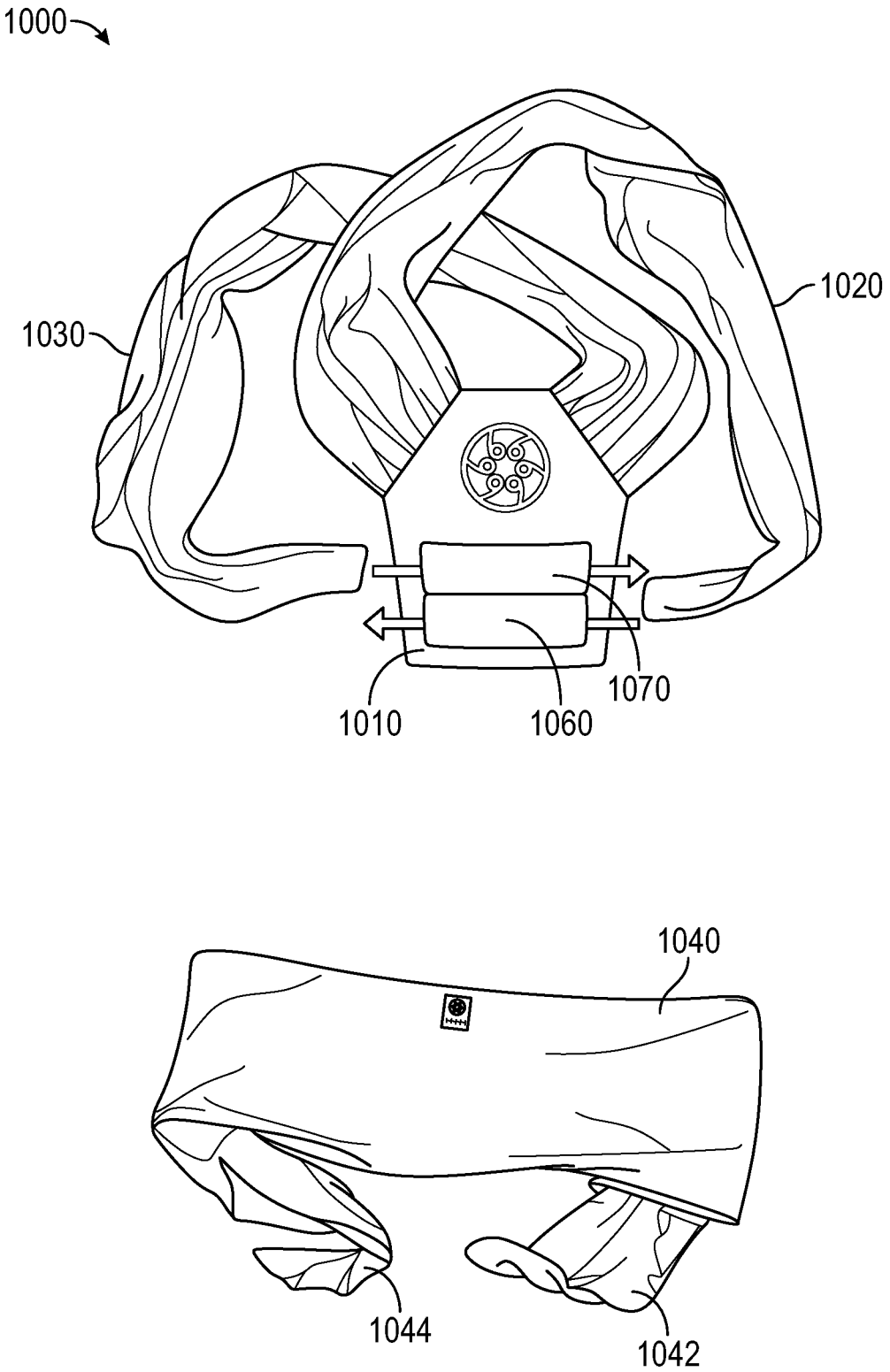
FIG. 10 is a diagram illustrating a baby carrier according to one of the various embodiments of the present disclosure.

FIG. 10 is a diagram illustrating a baby carrier according to one of the various embodiments of the present disclosure. A baby carrier 1000 may include a back panel 1010, wing elements 1020, 1030, a base portion 1040, and/or other components. The back panel 1010 may include channel elements 1060, 1070. As discussed herein, the wing elements 1020, 1030 may be passed through the channel elements 1060, 1070 during use. Depending on configuration, for example, a wing element 1020 may be passed through either channel element 1060 or channel element 1070. Similarly, wing element 1030 may be passed through either channel element 1060 or channel element 1070 depending on configuration. In certain cases, both wing elements 1020, 1030 may be passed through one of the channel elements 1060, 1070. The base portion includes one or more belt elements 1042, 1044. The baby carrier 1000 may be similar to baby carrier 100, 200, 300 of FIGS. 1-3, baby carrier 400 of FIGS. 4-6, baby carrier 700 of FIG. 7, baby carrier 800 of FIG. 8, and/or baby carrier 900 of FIG. 9 with certain variations.

Figure 11:
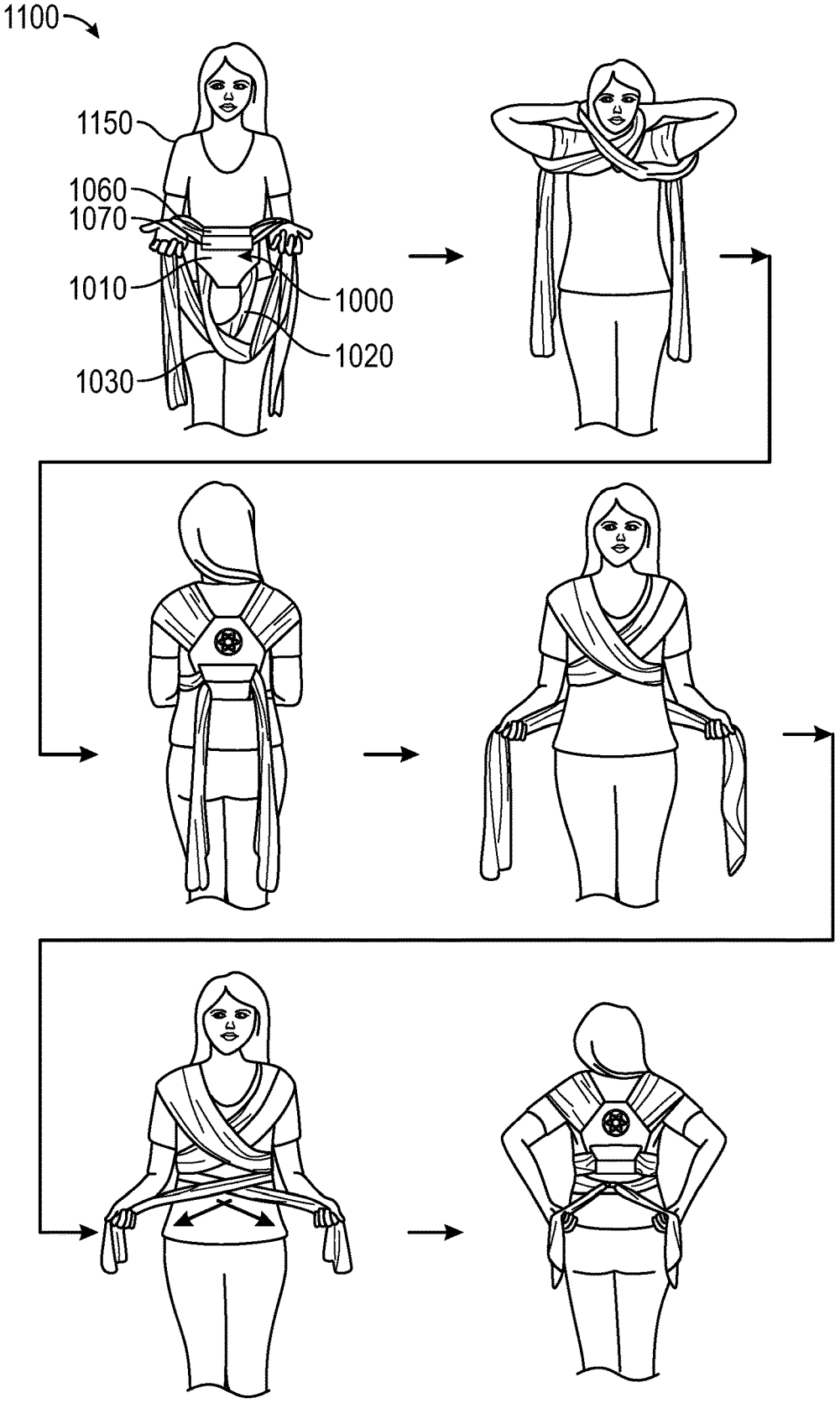
FIG. 11 is a diagram illustrating use of a baby carrier according to one of the various embodiments of the present disclosure.

FIG. 11 is a diagram illustrating use of a baby carrier according to one of the various embodiments of the present disclosure. A process 1100 of installing a baby carrier 1000 on an adult user 1150 (e.g., a wearer, wearer user) is depicted. In various embodiments, the baby carrier 1000 is attached to an adult user 1150 according to a set of steps. In a first step, the baby carrier 1000 is provided to the adult user 1150. The baby carrier 1000 may be configured for installation on the adult user 1150. For example, a left wing element 1020 is passed through a first channel element 1060, and a right wing element 1030 is passed through a second channel element 1070. In other instances, the carrier 1000 is configured differently. In a second step, the baby carrier 1000 is placed over the shoulders of the adult user 1150. The left wing element 1020 may be placed over the adult user's 1150 left shoulder and the right wing element 1030 may be placed over the adult user's 1150 right shoulder. In a third step, the baby carrier 1000 is adjusted to properly position the carrier 1000 on the adult user 1150. In a fourth step, the wing elements 1020, 1030 are passed around the midsection of the adult user 1150 from the back (posterior) to front (anterior). In a fifth step, the wing elements 1020, 1030 are crossed in front (anterior) of the adult user 1150. In a sixth step, the wing elements are tied behind (posterior) the adult user 1150.

Figure 12:
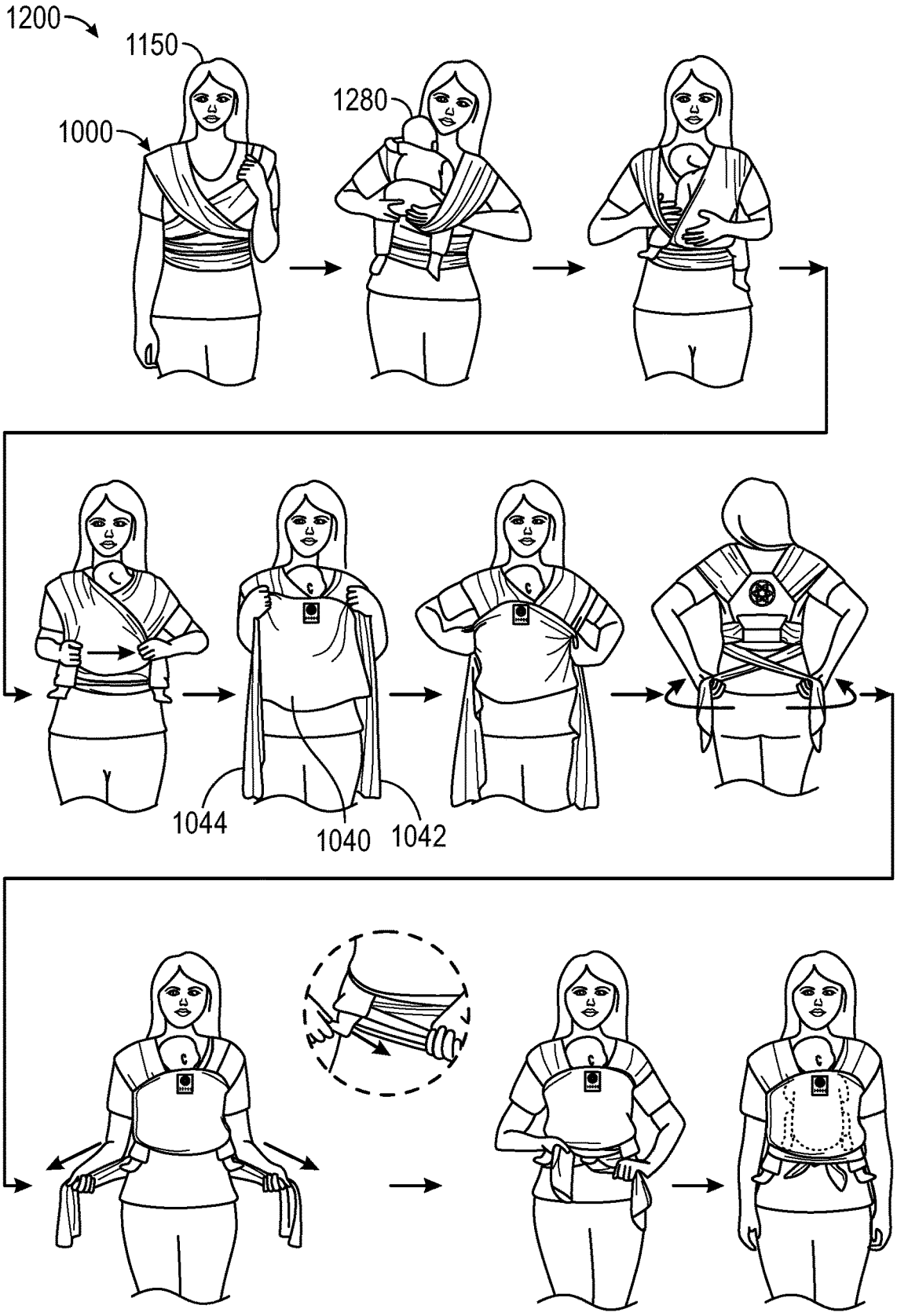
FIG. 12 is a diagram illustrating use of a baby carrier according to one of the various embodiments of the present disclosure.

FIG. 12 is a diagram illustrating use of a baby carrier according to one of the various embodiments of the present disclosure. A process 1200 of placing a child user 1280 a baby carrier 1000 installed on an adult user 1050 is depicted. In certain cases, the process 1200 may be performed after process 1100 (for example, after the baby carrier 1000 has been installed on the adult user 1150) and/or at another time. In a first step, the baby carrier 1000 is installed on an adult user 1150. The baby carrier 1000 may be installed on the adult user 1150 using, for example, the steps described in FIG. 11 and the process 1100 described therein. In a second step, a child user 1280 (e.g., a baby, infant, small animal) is placed in the baby carrier 1000. The child user 1280 may for example be placed against the chest of the adult user 1150 and the wing elements 1020, 1030 may be wrapped around the child user 1280. For example, a left wing element 1020 may be passed under a leg (e.g., a right leg) of the child user 1280. The right wing element 1030 may be passed under a leg (e.g., a left leg) of the child user 1280. In a third step, the wing elements 1020, 1030 are wrapped around the child user 1280, particularly the base (e.g., torso and legs) of the child user 1280. For example, the left wing element 1120 may be wrapped around the child user 1280 to further secure the child user 1280 to the adult user 1150. In a fourth step, the wing elements 1020, 1030 are further wrapped around the child user 1280. For example, the right wing element 1030 may be pulled across the legs and lower torso of the child user 1280 to provide support. In a fifth step, the base portion 1040 is provided. As discussed herein, the base portion 1040 may be used to provide further support and comfort for the child user 1280 and the adult user 1150. In a sixth step, the base portion 1040 is wrapped around the child user 1280 and the adult user 1150. In a seventh step, belt elements 1042, 1044 of the base portion 1040 are wrapped around the back of the adult user 1150. The belt elements 1042, 1044 may be passed around the back (posterior) of the adult user 1150 over a portion of the back panel 1010. In certain cases, the belt elements 1042, 1044 are passed through channels 1060, 1070 of the back panel 1010. In an eighth step, the belt elements 1042, 1044 are passed around the front (anterior) of the adult user 1150. The belt elements 1042, 1044 may, for example, be passed around the waist of the adult user 1150. In certain cases, the belt elements 1042, 1044 are passed between the feet or legs of the child user 1280 and the waist of the adult user 1150. In a ninth step, the belt elements 1042, 1044 are affixed to one another by, for example, tying a knot, VELCRO, buttons, snaps, and/or any other suitable fastening approach.

In various embodiments, the child user 1280 may be properly positioned in the baby carrier 1000 if the child user 1280 is upright, chest to chest with the adult user 1150, the child user's 1280 chin is not touching their chest, the child user's 1280 airway is clear, the child user's 1280 face is completely visible, and the child user's 1280 nose and mouth are free.

Figure 13:
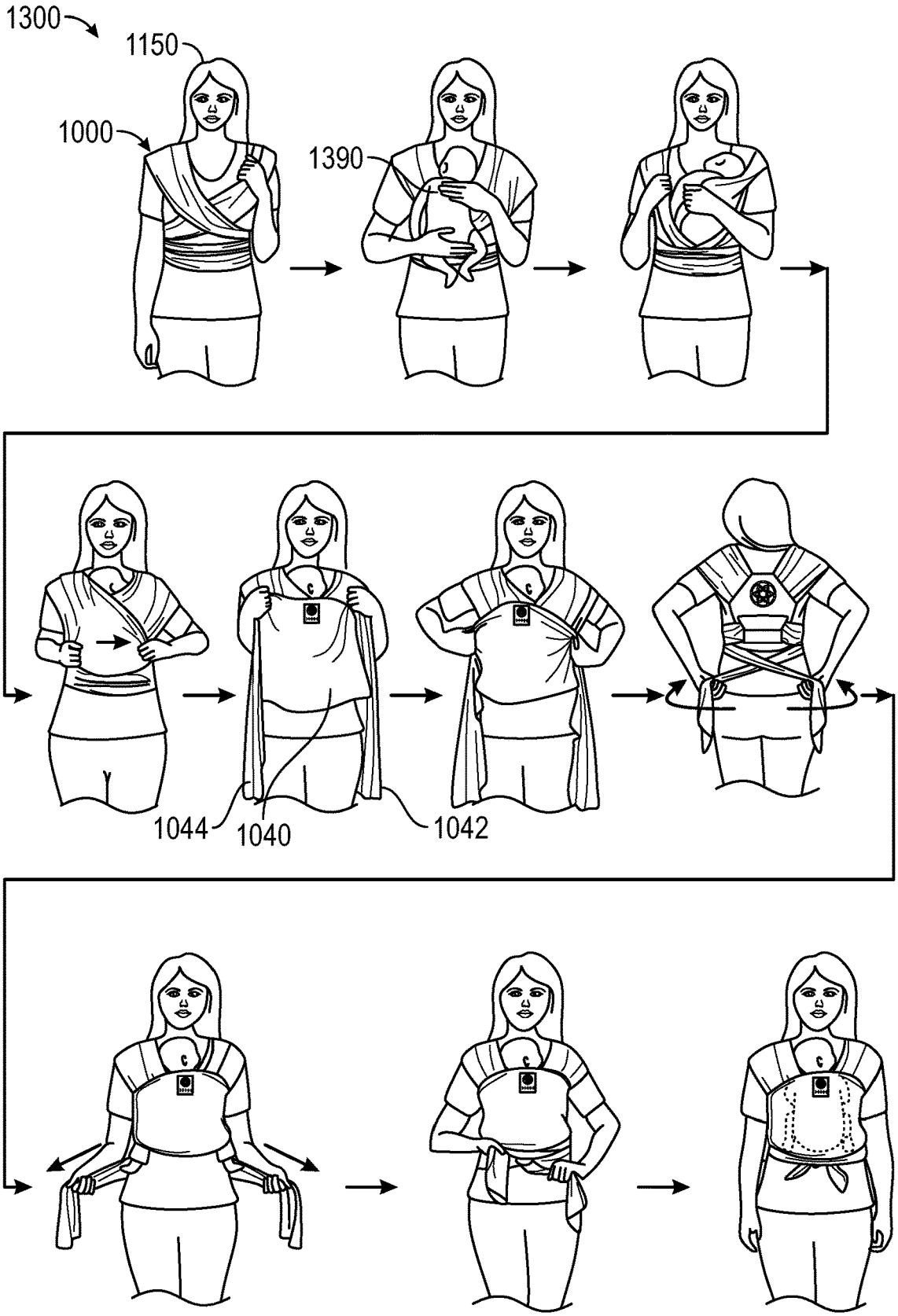
FIG. 13 is a diagram illustrating use of a baby carrier according to one of the various embodiments of the present disclosure.

FIG. 13 is a diagram illustrating use of a baby carrier according to one of the various embodiments of the present disclosure. A process 1300 of placing a child user 1390 in a baby carrier 1000 installed on an adult user 1050 is depicted. Process 1300 may be used to place an infant child user 1390 in the baby carrier 1000. The process 1300 may be similar to process 1200, with the exception of certain steps and/or procedures to accommodate a smaller (e.g., infant) child user 1390. In certain cases, the process 1300 may be performed after process 1100 (for example, after the baby carrier 1000 has been installed on the adult user 1150) and/or at another time. In a first step, the baby carrier 1000 is installed on an adult user 1150. The baby carrier 1000 may be installed on the adult user 1150 using, for example, the steps described in FIG. 11 and the process 1100 described therein. In a second step, an infant child user 1390 (e.g., an infant) is oriented to the baby carrier 1000 on the front (anterior) of the adult user 1150. The infant child user 1390 may be, for example, placed against the chest of the adult user 1150. In a third step, the infant child user 1390 is installed into the baby carrier 1000. The wing elements 1020, 1030 may be wrapped around the infant child user 1390. In a third step, the wing elements 1020, 1030 are wrapped around the infant child user 1390, particularly the base (e.g., torso and legs) of the infant child user 1390. For example, the left wing element 1120 may be wrapped around the legs and lower torso of an infant child user 1390 to further secure the infant child user 1390 to the adult user 1150. In a fourth step, the wing elements 1020, 1030 are further wrapped around the infant child user 1390. For example, the right wing element 1030 may be pulled across the legs and lower torso of the child user 1390 to provide further support. In a fifth step, the base portion 1040 is provided. In a sixth step, the base portion 1040 is wrapped around the infant child user 1390 and the adult user 1150. In a seventh step, belt elements 1042, 1044 of the base portion 1040 are wrapped around the back of the adult user 1150. The belt elements 1042, 1044 may be passed around the back (posterior) of the adult user 1150 over a portion of the back panel 1010. In an eighth step, the belt elements 1042, 1044 are passed around the front (anterior) of the adult user 1150. The belt elements 1042, 1044 may, for example, be passed around the waist of the adult user 1150. In certain cases, the belt elements 1042, 1044 are passed between the feet or legs of the infant child user 1390 and the waist of the adult user 1150. In a ninth step, the belt elements 1042, 1044 are affixed to one another by, for example, tying a knot, VELCRO, buttons, snaps, and/or any other suitable fastening approach.

Figure 14:
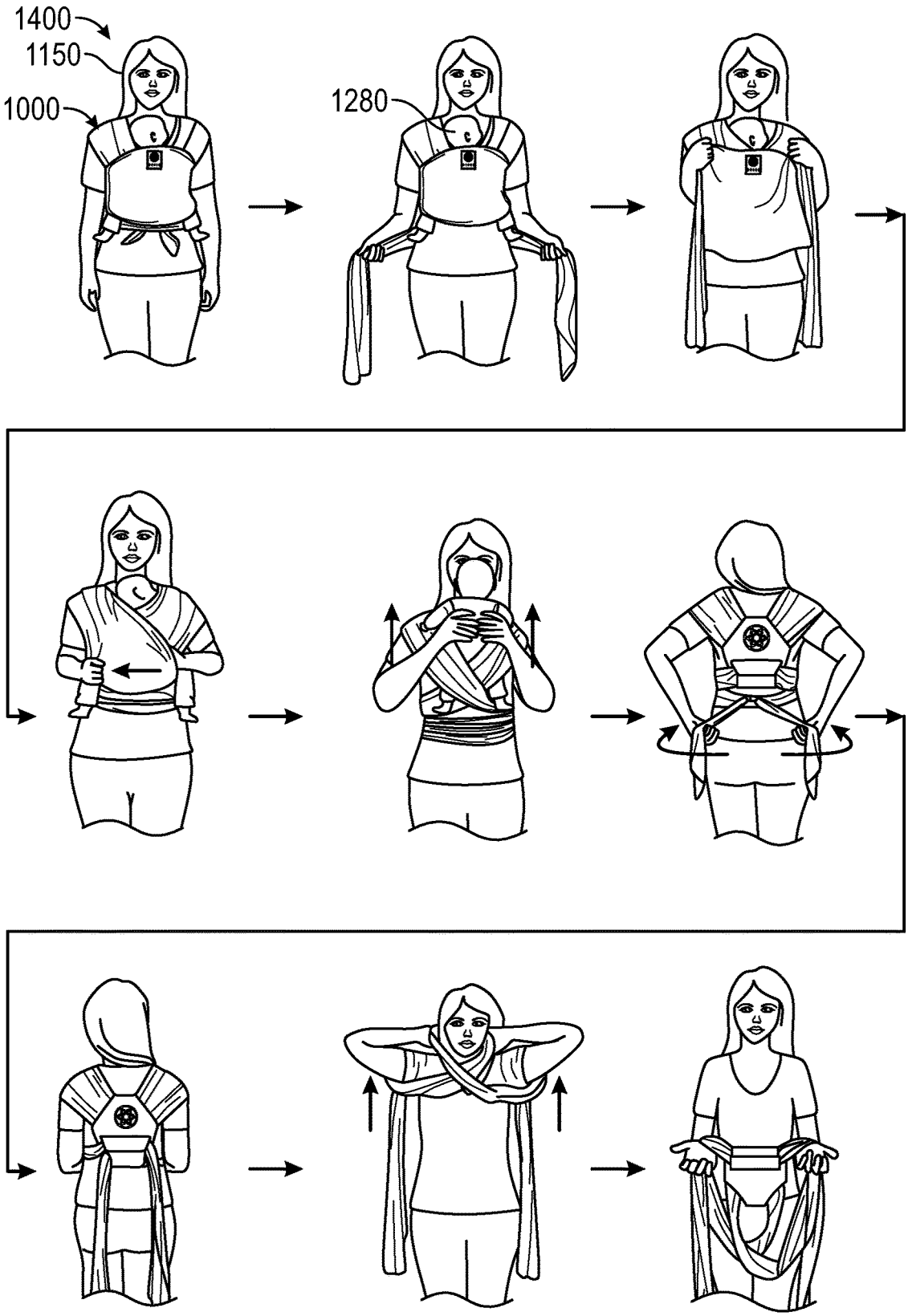
FIG. 14 is a diagram illustrating removal of a baby carrier from a user according to one of the various embodiments of the present disclosure.

FIG. 14 is a diagram illustrating removal of a baby carrier from a user according to one of the various embodiments of the present disclosure. A process 1400 of removing a child user 1280, 1390 from a baby carrier 1000 and removing the baby carrier from the adult user 1150 is depicted. In certain cases, the process 1400 may be performed after one or more of processes 1100, 1200, 1300 (for example, after the baby carrier 1000 has been installed on the adult user 1150 and the child user 1280, 1390 installed in the baby carrier 1000) and/or at another time. In a first step, the baby carrier 1000 is installed on an adult user 1150 and the child user 1280, 1390 is installed in the baby carrier 1000. These operations may be performed using the steps described in one or more of FIGS. 11-13 and one or more of the processes 1100, 1200, 1300 described therein. In a second step, the wing elements 1042, 1044 and undone (e.g., unaffixed, unfastened from one another). The adult user 1150 may for example untie a knot including the wing elements 1042, 1044. In a third step, the base portion 1040 is removed and set aside. In a fourth step, the wing elements 1020, 1030 are loosened and/or unwrapped from around the child user 1280, 1390. In a fifth step, a child user 1280, 1390 is removed from the baby carrier 1000. In a sixth step, wing elements 1020, 1030 are untied from for example the back of the adult user 1150. In step seven, the wing elements 1020, 1030 are loosened. In steps eight and nine, the baby carrier 1000 is removed from the adult user 1150. The baby carrier 1000 may be set aside for later use.

Various exemplary embodiments of a baby carrier are described herein, including baby carriers 100, 200, 300, 400, 700, 800, 900, 1000. For brevity and to avoid unnecessary repetition, elements similar to multiple baby carrier designs may not be discussed in full detail in the description for each design. It would be apparent to one of ordinary skill in the art that features of the various baby carrier designs described herein may be interchangeable across the multiple baby carrier designs.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

What is claimed is:

1. A baby carrier comprising:

a plurality of wing elements including a first fabric, each of the wing elements including a terminal end; and a back panel affixed to each of the wing elements, the back panel including a second fabric and at least one opening configured to allow the terminal end of one of the wing elements to pass through the back panel to secure the back panel to the wing elements, wherein the at least one opening comprises at least one channel that spans at least half of the back panel, wherein each said at least one channel is configured to accommodate a wing element passing therethrough during use.

2. The baby carrier of claim 1, wherein the at least one channel includes at least one fabric panel sewn onto the back panel to form a passage to accommodate the wing elements.

3. The baby carrier of claim 1, wherein the at least one opening includes a plurality of openings into a hollow interior of the back panel.

4. The baby carrier of claim 3, wherein each of the wing elements is configured to pass through a first of the openings into the hollow interior of the back panel and out through a second of the openings.

5. The baby carrier of claim 1, wherein the at least one opening includes button holes through which the wing elements pass during use to secure the wing elements to the back panel.

6. The baby carrier of claim 1, wherein the first fabric is different from the second fabric.

7. The baby carrier of claim 1, wherein the first fabric includes an elastic fabric and the second fabric includes one or more layers of minimally elastic material.

8. The baby carrier of claim 7, wherein the second fabric includes at least one layer of knit fabric and at least one layer of non-woven interlining.

9. The baby carrier of claim 1, wherein at least a portion of the first fabric and second fabric include water resistant material.

10. The baby carrier of claim 1, wherein the back panel includes one or more of a triangular, rectangular, pentagonal, trapezoidal, and coffin shape to accommodate a posterior torso of an adult.

11. The baby carrier of claim 1, wherein the wing elements are attached to the back panel at an angle relative to vertical.

12. The baby carrier of claim 1, wherein the wing elements are configured to pass through the openings in the back panel and to be tied in a knot to secure a child to a torso of an adult.

13. A baby carrier comprising:

a plurality of wing elements including a first fabric, each of the wing elements including a terminal end;

a back panel affixed to each of the wing elements, the back panel including a second fabric and at least one opening configured to allow the terminal end of one of the wing elements to pass through the back panel to secure the back panel to the wing elements; and a base portion configured to support the lower torso of a child wherein the base portion includes at least one second opening configured to allow the terminal end of one of the wing elements to pass through to secure the base portion to the wing elements and back panel.

* * * * *